US008497639B2

(12) United States Patent
Tsang et al.

(10) Patent No.: US 8,497,639 B2
(45) Date of Patent: Jul. 30, 2013

(54) LIGHTING DEVICE WITH DYNAMIC LIGHT EFFECTS

(75) Inventors: Peter Tjin Sjoe Kong Tsang, Eindhoven (NL); Constantin Alexandru Opran, Eindhoven (NL); Stuart Ronald Pill, Cramlington (GB); Daniel Karl Pezzutti, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 244 days.

(21) Appl. No.: 13/057,358

(22) PCT Filed: Aug. 3, 2009

(86) PCT No.: PCT/IB2009/053362

§ 371 (c)(1),
(2), (4) Date: Feb. 3, 2011

(87) PCT Pub. No.: WO2010/015990

PCT Pub. Date: Feb. 11, 2010

(65) Prior Publication Data

US 2011/0133672 A1 Jun. 9, 2011

(30) Foreign Application Priority Data

Aug. 7, 2008 (EP) ..... 08161974

(51) Int. Cl.
*H05B 37/00* (2006.01)
*F21V 9/00* (2006.01)

(52) U.S. Cl.
USPC ..... 315/291; 315/363; 362/235; 362/293

(58) Field of Classification Search
USPC ..... 362/61, 276, 293, 307, 308, 311, 362/326, 351, 458, 235; 315/291, 294, 307, 315/363
See application file for complete search history.

(56) References Cited

U.S. PATENT DOCUMENTS

| | | | | |
|---|---|---|---|---|
| 3,134,674 | A | 5/1964 | Brown, Jr. | |
| 3,323,244 | A | 6/1967 | Schreiber | |
| 5,228,767 | A | 7/1993 | Johnson | |
| 7,419,265 | B2 * | 9/2008 | Relke et al. | 353/7 |
| 7,742,070 | B2 * | 6/2010 | Glatt | 348/36 |
| 2004/0135097 | A1 * | 7/2004 | Shibahashi et al. | 250/474.1 |
| 2006/0112599 | A1 * | 6/2006 | Braynock et al. | 36/137 |
| 2006/0244682 | A1 * | 11/2006 | Brueggert et al. | 345/48 |

FOREIGN PATENT DOCUMENTS

| | | | |
|---|---|---|---|
| DE | 202007015925 | U1 | 2/2008 |
| JP | 2004182107 | A | 7/2004 |
| WO | 2007106547 | A2 | 9/2007 |

* cited by examiner

*Primary Examiner* — Jimmy Vu
(74) *Attorney, Agent, or Firm* — Mark L. Beloborodov

(57) ABSTRACT

The invention provides a lighting device comprising a housing. The housing comprises visible-light sources (10) arranged to generate visible light (11), UV-lightsources (12) arranged to generate UV-light (13), a light exit window (14) positioned to allow transmission of the visible light (11), a photochromic layer (16) positioned upstream of the light exit window (14) and downstream of the visible light sources (10), the photochromic layer (16) comprising at least one area with UV-photochromic material (15), the UV-photochromic material (15) having a first color state and a second color state, and a control unit (40) connected to the UV-light sources (12) for controlling the UV-light sources (12), wherein the UV-light sources are arranged to illuminate the photochromic layer (16). The invention makes it possible to obtain dynamic light effects.

14 Claims, 3 Drawing Sheets

LIGHTING DEVICE WITH DYNAMIC LIGHT EFFECTS

FIELD OF THE INVENTION

The present invention relates to a lighting device. More in particular, the invention relates to a lighting device for generating dynamic light effects.

BACKGROUND OF THE INVENTION

RGB lights are available in many guises. Many offer a variable range of color and intensity settings. In most cases there are no dynamic effects apart from projection lamps used in discos, such as GOBO (Goes Before Optics or Graphical Optical BlackOut) or projector type devices. These devices may be based on mechanical turning wheels, slides, or even LCD and DLP (Digital Light Processing) type technologies for modulating the light. Dynamic effects also include flashing and color changing lights; in these cases the light effect is dynamic while the source is static.

Projected patterns are to be alternated in order to obtain a dynamic light pattern with turning wheels or slides. This makes the lighting device mechanically complex, with relatively large lighting device constructions. The use of LCD and DLP type technology is electrically complex and requires user dedicated knowledge to make use of all possible features.

The use of photochromic materials is known in the art. U.S. Pat. No. 5,228,767, for example, discloses a headlight lens manufactured from photochromic glass such that the headlight is not noticeable during daylight hours when subjected to ultraviolet light. At night, in the absence of ultraviolet light, the lens is transparent and emits the light from inside the headlight.

SUMMARY OF THE INVENTION

It is desirable to provide an alternative lighting device that renders dynamic light effects possible. Prior art lamps may have the disadvantage of moving parts, such as turning wheels or slides, and may have a complex structure.

Hence, it is an object of the invention to provide an alternative lighting device which preferably at least partly obviates one or more of above-described drawbacks. The present invention provides an alternative lighting device for generating dynamic light effects.

According to a first aspect of the invention, a lighting device is provided which comprises:

a. one or more visible-light sources arranged to generate visible light;
b. one or more UV-light sources arranged to generate UV-light;
c. a light exit window positioned to allow transmission of the visible light;
d. a photochromic layer positioned upstream of the light exit window and downstream of the one or more visible light sources, said photochromic layer comprising at least one area with UV-photochromic material, the UV-photochromic material having a first color state and a second color state; and
e. a control unit connected to the one or more UV-light sources for controlling the one or more UV-light sources, said UV-light sources being arranged to illuminate the photochromic layer.

In this way, advantageously, an alternative lighting device for generating dynamic light patterns is provided. The lighting device according to the invention uses UV-photochromic material in order to obtain dynamic light patterns.

Photochromism is the reversible transformation of a chemical species between two forms by the absorption of electromagnetic radiation, where the two forms have different absorption spectra. Photochromism does not have a rigorous definition, but is usually used to describe compounds that undergo a reversible photochemical reaction where an absorption band in the visible part of the electromagnetic spectrum changes dramatically in strength or wavelength. There are UV-photochromic materials on the market which substantially do not absorb visible light in a first state and, upon activation with UV-light, do substantially absorb part of the visible light in a second state. After the UV-light has been switched off, the photochromic material fades from the second state to the first state. According to the present invention, the photochromic layer is used as a dynamic color filter for the visible light from the visible light source.

In an embodiment, the photochromic layer comprises at least two areas with different UV-photochromic materials, the UV-photochromic materials having different recovery times. This feature improves the dynamic light effect of the lighting device.

In an embodiment, the device comprises two or more UV-light sources, each of the two or more UV-light sources being arranged to expose different areas of the photochromic layer during operation. This feature provides the possibility to activate different areas of the photochromic layer independently of each other. In a further embodiment, the control unit is arranged to control the two or more UV-light sources independently of each other. These features further improve the dynamic lighting effect of the lighting device.

In an embodiment, the photochromic material is applied to the inner side of the light exit window.

In an embodiment, the lighting device further comprises a UV-filter provided downstream of the one or more UV-light sources and upstream of the photochromic material, wherein the UV-filter has a predetermined recovery time. In a further embodiment, the device comprises an IR-light source arranged to generated IR-light, wherein the UV-filter comprises a thermoscattering material. These features provide means for illuminating different areas of a photochromic material with different intensities of UV-light from one UV-light source. Thus two areas having different color intensities can be obtained within one area of photochromic material during operation.

In an embodiment, the device comprises a UV-filter downstream of the light exit window. This feature renders the dynamic lighting effect substantially insensitive to external UV-light sources, such as sunlight. In this way, UV-light (from the sun substantially cannot reach the photochromic material(s), so that the photochromic material(s) are substantially only addressed by the UV-light source(s).

In an embodiment, the controller is arranged to generate a PWM (pulse width modulation) signal to control the UV-light source(s). In a further embodiment, the controller is arranged to generate a PWM signal to control the transition from the first color state to the second color state of the photochromic material(s). These features render it possible to control the intensity of UV-light to which the photochromic material is exposed, and consequently the amount of UV-light in time. The amount of UV-light provided determines the degree of activation of the photochromic material and consequently the intensity of the color of the photochromic material. The dynamic lighting effect is further improved in that the intensity and amount of UV-light to which the photochromic material is exposed are controlled.

In a further embodiment, the controller is arranged to generate a PWM signal to control the transition from the second color state to the first color state. Exposing the photochromic material to a reduced amount of UV-light during the fading from the second, i.e. activated state to the first, i.e. non-activated state will activate part of the photochromic material again, which prolongs the time period from the fully activated state to the fully non-activated state of the photochromic material.

In an embodiment, the controller is arranged to control the intensity of the color of the UV-photochromic material. In a predetermined time period a minimum amount of UV-light should be provided in order to activate the photochromic material fully. If an amount of UV-light below said minimum is provided, only part of the photochromic material will be activated. The percentage of activated material determines the intensity of the color of the material. Controlling the color intensity serves to vary the dynamic light effect further.

In an embodiment, a UV-light source is arranged to generate a spot of UV-light on the photochromic material, and the lighting device further comprises a beam controller for directing the spot of UV-light across the photochromic material. These features allow the lighting device to create patterns of UV-lights on the photochromic material, which will result in corresponding patterns of activated photochromic material.

In an embodiment, the photochromic layer is part of a detachable unit. The photochromic material may be an ink that is painted on the detachable unit by users. This feature allows users to develop a lighting device with their personally designed dynamic lighting effects.

In another aspect of the invention, a kit of parts is provided for generating a detachable unit for use in a lighting device according to the invention, the kit of parts comprising at least a transparent body, a container with a photochromic ink, and optionally a tool for writing on the photochromic layer by means of a UV LED pen, so as to create fading patterns.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
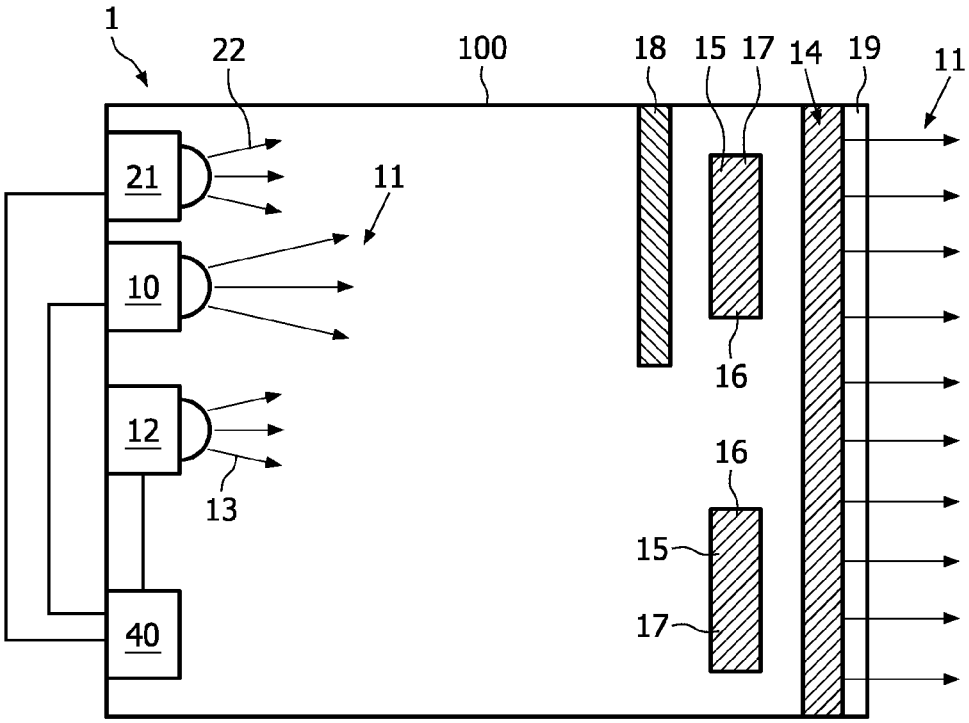
FIG. 1 schematically depicts an embodiment of the lighting device according to the invention.

FIG. 1 schematically depicts a first embodiment of the lighting device 1 according to the invention. The lighting device 1 comprises a visible-light source 10, a UV-light source 12, a control unit 40, a photochromic layer 16, and a light exit window 14 (also denoted "exit window"). The visible-light source 10 is arranged to generate visible light 11 which exits the lighting device through the exit window 14.

The term " visible light" herein especially refers to visible radiation (VIS), i.e. radiation in the range of about 400 to 780 nm. For example, the light source 10 used may be a set of blue, green, and red LEDs. When such multiple sources of multiple colors are used as the light source(s) 10, the sources may be arranged so as to be able to generate white light (by color mixing). Likewise, this may be achieved by mixing blue light of a blue-light emitting source and yellow light of a yellow-light emitting source (including white LEDs based on blue LEDs and a yellow-light emitting phosphor), as is known in the art. However, any visible light source may be used, provided it substantially does not emit UV-light.

A photochromic layer 16 is provided upstream of the exit window 14. The terms "upstream" and "downstream" relate to the direction of propagation of the beam of light 11, i.e. relative to a first position within the beam of light 11, a second position in the beam of light closer to the light source 10 will be 'upstream', and a third position within the beam of light further away from the light source 10 will be 'downstream'. In FIG. 1, for example, the exit window 14 is downstream of the light sources 10 and the light sources 10 are upstream of the exit window 14. The photochromic layer 16 is arranged downstream of the light sources 10, but upstream of the exit window 14.

Figure 2:
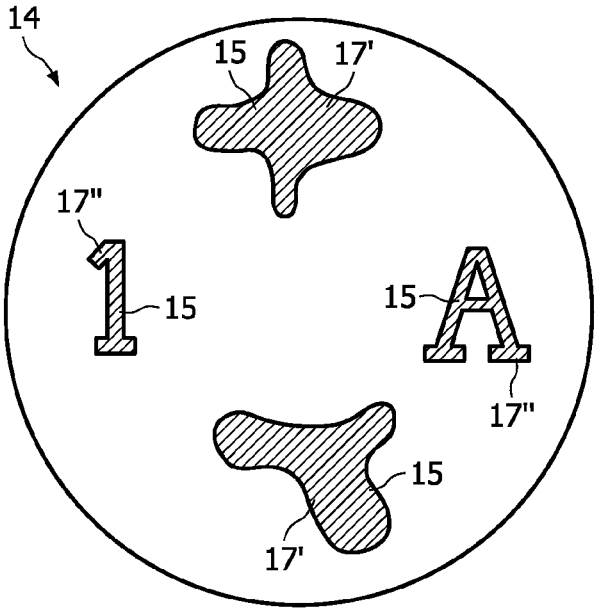
FIG. 2 shows an example of a downstream view of the photochromic material and exit window.

The photochromic layer 16 comprises areas provided with photochromic material 15. The photochromic material is preferably a UV-photochromic material. Commonly known UV-photochromic materials are more or less colorless until exposed to sufficient UV-light or sunlight. Upon exposure to UV-light, the material becomes substantially more brightly colored and then fades back to colorless once the UV-light is removed. The photochromic layer 16 may comprise different areas 17 of photochromic material 15. Preferably, the photochromic material is arranged to allow at least part of the visible light 11 to pass through the photochromic material 15 substantially unhindered so as to escape to the exterior of the lighting device 1. Embodiments of this are shown in FIGS. 1 and 2. Part of the light 11 may be transmitted through or substantially blocked by the photochromic material 15 in the indicated areas 17 in these embodiments, whereas another part of the light 11 escapes to exterior of the lighting device 1 substantially unhindered by the presence of the photochromic material.

Examples of types of photochromic materials are: spiro-naphthoxazines and naphthopyrans. Further information on photochromism is available on www.photochromrics.co.uk.

The UV-light source 12 is arranged to generate the UV-light for changing the photochromic material 15 from the first color state or non-activated state to a second color state or activated state. The term "UV light" especially relates to radiation with a wavelength selected from the range of about 200 to 400 nm, especially about 300 to 400 nm.

Preferably, a photochromic material is used which has a first color state which is substantially colorless and a second color state wherein the material is brightly colored. Changing the color of the photochromic material changes the color of the visible light exiting the lighting device 1 through the light exit window 14. To obtain a dynamic light effect, the UV-light source 12 is electrically coupled to the control unit 40. The control unit 40 generates a signal that switches the UV-light source 12 alternatingly on and off so as to obtain modulated UV-light. The photochromic material 15 will move from colorless to colorful and vice versa in response to the alternating exposure to UV-light. A lighting device 1 with a switchable light pattern effect is thus achieved substantially without moving parts. The photochromic layer will fade to colorless and remains colorless as long it is not exposed to UV-light. This means that the lighting device operates as a normal lighting device without dynamic effects as long as the UV-light source is not used. The photochromic material is activated when UV light is incident on the UV-photochromic material 15 and causes the material to change color, thus providing a dynamic light effect. The light emitted from the lighting device 1 will now be influenced by the change in color of the photochromic material 15, and a projected pattern corresponding to the areas of photochromic material will be visible, for example on a wall. As shown in FIG. 1, the photochromic layer 16 comprises areas with photochromic material 15. FIG. 2 shows a downstream view of the areas of the photochromic material 15 and the exit window 14 by way of example. When activated, the patterns of the partially of fully activated photochromic materials will be visible as projections on a wall or ceiling.

The time needed to change the photochromatic material from the fully non-activated state to the fully activated state depends on the flux of the UV-light and the exposure time. The activation time can be much less than 1 second. The time needed to change the chromatic material from the fully activated state to the fully non-activated state depends on the fade rate or recovery time of the photochromic material. It should be noted that each photochromic material has a characteristic fade rate or recovery time. For example, there are photochromic materials whose dyes fade by 75% from their maximum intensity in 12 second and other materials whose dyes fade by 75% from their maximum in 1865 seconds. The use of areas with different fading characteristics render it possible to create an additional dynamic light effect, some areas fading back to the colorless state faster than others.

In an embodiment, the control unit 40 comprises a processor and a memory containing instructions which, when executed on the processor, enable the processor to generate a control signal for switching on/off the UV-light source 12 in a pre-programmed sequence so as to create pre-programmed light effects. Optionally, the visible-light source 10 may be electrically connected to the control unit 40 to modulate the visual light 11.

The light exit window 14 is arranged to allow transmission of the visible light 11. This may imply that the exit window comprises a transparent material and/or a translucent material. The phrase "allow transmission" indicates that light passes through the window, diffusively or non-diffusively. The translucent material may be a roughened transparent material. Methods to make translucent materials are known in the art. Examples of suitable transparent materials which can be used may be selected, for example, from the group comprising glass, PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), polycarbonate, polyvinylchloride (PVC), polyethyleneterephthalate (PET), glycol modified polyethyleneterephthalate (PETG), PDMS (polydimethylsiloxane), and COC (cyclo olefin copolymer), which materials may be provided as transparent sheets. In another embodiment, the translucent material comprises an acrylate, for example PMA or PMMA, especially PMMA. Such materials are also known in the art as transparent plastics. In yet another embodiment, the translucent material comprises transparent plastics commercially known as PERSPEX™ or PRISMEX™. Other substantially transparent materials known to those skilled in the art may also be used. Combinations of two (or more) materials may be used.

As described above, the photochromic material 15 is activated by exposure to UV-light. To prevent the photochromic material 15 being activated by sunlight or other external UV-light sources, said UV-light should substantially be blocked. Therefore, the light exit window 14 may have properties to block the external UV-light. The light exit window 14 may be made of a material which filters or blocks out UV-light. If the material of the light exit window does not block the UV-light sufficiently, a UV filter 19 may be provided on the light exit window 14. In FIG. 1, the UV-filter 19 is a coating on the outer surface of the exit window 14 and functions as a UV-blocker. The UV-filter may alternatively be a coating on the inner surface of the light exit window 14. In principle, the UV-filter 19 for blocking the external UV-light may be in any position downstream of the photochromic layer 16.

Optionally, a UV-filter 18 may be provided downstream of the UV-light source 12 and upstream of the photochromic layer 16. The UV-filter 18 may be a separate layer or a coating on the photochromic material 15.

The UV-filter 18 may comprise a photochromic material, since such materials may also be used as UV-filters.

The UV-filter 18 may comprise a thermoscattering material. In that case, the lighting device 1 further comprises one or more IR-light sources 21 arranged to generate IR-light. The term "IR light" especially relates to light having a wavelength selected from the range of about 780 nm to 1 mm. The IR-light is used to change the state of the thermoscattering material. Thermoscattering materials are known, for example, from U.S. Pat. No. 4,900,135 and U.S. Pat. No. 6,362,303.

The UV-filter 18 has a predetermined recovery time and functions as a UV-blocker, reducing the amount of UV-light incident on the UV-photochromic material 15. The UV-filter 18 preferably does not extend across all the photochromic material 15, but only covers specific areas. Furthermore, the UV-filter 18 may have varying filtering characteristics across the filtering area, for example owing to different thicknesses of the layer forming the UV-filter 18. The photochromic material can thus be exposed to different amounts of UV-light, which results in different color intensities of the photochromic material 15. This makes different fade times possible, and thus an additional dynamic range of pattern changes as a function of time. The fade time or recovery time can be expressed as the time period needed to fade by a predefined percentage from the maximum color intensity. Some percentages used are 25%, 50%, 75%. It will be clear to those skilled in the art that the fade time of a photochromic material increases with an increase in the prevailing color intensity.

The IR light source 21 is electrically connected to the control unit 40. The control unit 40 is arranged to control the IR light source 21 to generate a modulated beam of IR-light 22, which in its turn influences the properties of the UV-filter 18, in embodiments in which the UV-filter comprises a thermoscattering material. When the material of the UV-filter 18 is heated, the filter will change from a UV-blocking state (scattering state) to a non-blocking state (transparent state), or vice versa, depending on the type of thermoscattering material. The intensity of the UV-light 13 to which the UV-photochromic material 15 of the photochromic layer 16 is exposed can be controlled in this manner.

Figure 3:
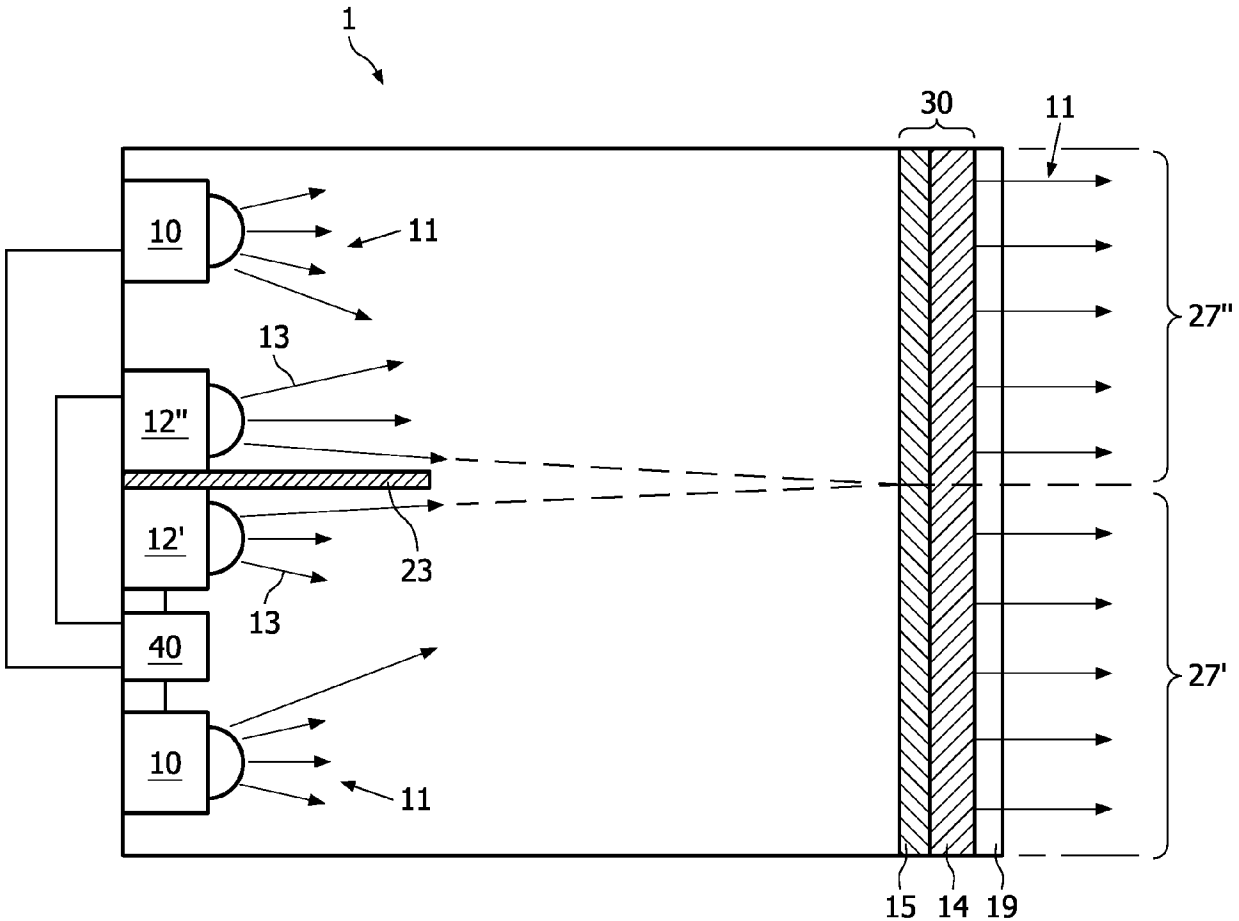
FIG. 3 schematically depicts a second embodiment of the lighting device.

FIG. 3 schematically depicts a second embodiment of the lighting device 1. In this embodiment, the photochromic material 15 forming the photochromic layer 16 is a coating on the inner side of the light exit window 14. The photochromic material 15 may be applied to the light exit window 14 by means of painting or inking The photochromic material 15 extends at least partly along the inner surface of the light exit window 14.

The photochromic material 15, optionally the light exit window 14, and optionally the UV-filter 19 at the outer surface of the light exit window 14 may be part of or form a detachable unit 30. A user can then remove the detachable unit 30 provided with a particular pattern of photochromic material 15 and replace it with another detachable unit 30 with a different pattern.

The lighting device 1 according to the second embodiment is further provided with two visible-light sources 10 and two UV-light sources 12', 12". Each of the UV-light sources 12' and 12" is arranged to irradiate different areas 27' and 27" of the photochromic layer 16. The different areas 27', 27" may have overlapping areas, or one area may encompass the other area. The two UV-light sources 12' and 12" are both electrically connected to the control unit 40. Preferably, the two UV-light sources 12' and 12" can be controlled independently of each other. In FIG. 3, a louver 23 between the two UV-light sources 12' and 12" is provided to obtain two different UV-light beams 13 that are incident on two different areas or regions 27' and 27" of the photochromic material 15. Instead of a louver 23 as shown in FIG. 3, beam controllers, collimators, mirrors, lenses, and other light-guiding means commonly known to those skilled in the art may be used to obtain two beams of light incident on two different regions of the photochromic material 15.

With two or more UV-light sources 12' and 12", which can be independently switched on and off, it is possible to activate different areas of the photochromic material 15 with different fluxes and at different moments in time. Each area of photochromic material 15 can thus have a different color intensity and provide a different dynamic light effect.

The UV-light source(s) 12, 12' and 12" may be arranged so as to generate a sufficient flux of UV-light to switch the photochromic material 15 from its fully non-activated state, i.e. the substantially colorless state for a category of photochromic materials, to its fully activated state, i.e. the color state with maximum intensity, in a few tenths of a second. The fade-on period, i.e. the time period required to change the photochromic material from the fully non-activated state to the fully activated state, may be extended by a decrease in the flux or average flux of the UV-light to which the photochromic material is exposed. This may be done by reducing the power supplied or transmitted to the UV-light source(s) 12. In an embodiment, the power is reduced by switching the UV-light source 12 on and off by means of a pulse width modulated (PWM) signal. This may be done by supplying a PWM supply voltage/current to the UV-light source(s). Other embodiments and corresponding circuitry to obtain a PWM UV-light by means of a UV-light source are commonly known to those skilled in the art. The controller 40 is arranged to generate the PWM signal to control the UV-light source(s) 12', 12". The pattern of the PWM signal will determine the fade-on characteristics, i.e. the transition characteristics from the first color state to the second color state. Transition characteristics may be the fade on period and the gradient of the color intensity in time. For example, it is possible to increase the color intensity linearly, logarithmically, or inverse-logarithmically in time.

Furthermore, the controller 40 may be arranged to control the transition from the second color state, i.e. the activated state, to the first color state, i.e. the non-activated state, of the photochromic material 15. If the photochromic material 15 is not exposed to UV-light 13, the material 15 will fade from the activated state to the non-activated state. Each UV-photochromic material 15 has its own fade rate. A small percentage of the UV-photochromic material may be activated again by a generation of short pulses of UV-light, which results in an increase in the color intensity of the photochromic material. A PWM signal may be used to generate the short pulses of UV-light. It is possible in this way to extend the noticeable fade rate of the material 15. It is even possible to maintain the color intensity of the photochromic material 15 at a predefined level. The total width of a pulse or number of pulses in a short time window will determine the degree of increase in color intensity of the photochromic material 15.

In general, a pulse of the PWM UV-light will increase the color intensity of the photochromic material 15 in a controllable way. As the fade rate of the photochromic material 15 is known, those skilled in the art will be able to produce a PWM control signal for any color intensity gradient of the corresponding photochromic material 15.

Figure 4:
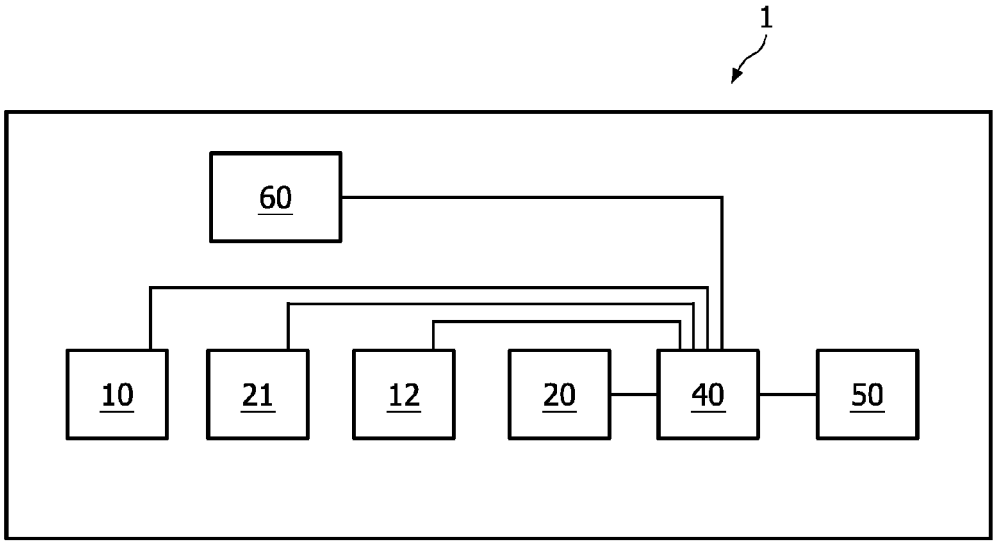
FIG. 4 schematically depicts a general embodiment of a lighting device according to the invention.

FIG. 4 is a block diagram of a lighting device 1 according to the invention. The device 1 comprises one or more visible-light sources 10, one or more UV-light sources 12, optionally one or more IR-light sources 21, and a control unit 40. The lighting device 1 further comprises a user interface 50. The user interface 50 is electrically connected to the control unit 40. The user interface 50 or user input device ("local" or "remote") controls the lighting generated by the light emitting device 1 as selected by the user. The interface or input device 50 may comprise control action buttons showing in an intuitive way how the end user can navigate along the available settings. An intelligent microprocessor may allow a user to generate dynamic light effects via an algorithm. The user interface 50 may comprise a remote control unit.

Optionally, the lighting device 1 may comprise sensors 60 to measure (bio)physical input parameters, to record audio and video signals, to measure lighting conditions, etc.

Intelligent (bio)physical input parameters and/or audio/video monitoring can be used to translate a person's behavior automatically (motion, voice, music selected, facial expression) or activities (waking up, reading, falling asleep) into a certain setting of the lighting device or its dynamic lighting effect. Various possibilities exist, as summarized below, without the invention being limited thereto.

To detect the users mood/emotion, one or more sensors 60 may be applied as separate devices and/or be combined within the user interface 43. Alternatively, video/audio recordings may be used to detect voice and/or facial expression (smiling, sad, laughing, open/closed eyes, waking up, drowsy, sleepy).

In an embodiment, the sensor 60 comprises a distance sensor for measuring the distance up to a targeted wall or ceiling. The measured distance provides an indication of the best focal distance for clear projections. In addition, the lighting device 1 may comprise a focusing structure (not shown), for example a movable lens or a light source that is movable with respect to a lens, to add a self-focusing capability to the lighting device 1.

In an embodiment, the UV-light source 12 comprises a laser device for generating a UV laser beam and a beam controller 20 to guide the UV laser beam across the photochromic layer 16. The UV laser beam may illuminate only a small spot of the photochromic material 15 and consequently a small area will have high color intensity. The beam controller 20 is capable of moving the spot across the photochromic material 15, leaving a track of photochromic material 15 of increased color intensity. Thus patterns can be drawn on the photochromic material by techniques similar to laser image generation in laser shows. The beam controller 20 may comprise a mirror whose orientation can be controlled. In another embodiment, the UV-light source is mounted on an arrangement capable of changing the orientation of the UV-light source such that the laser spot is moved across the photochromic material 15.

In an embodiment, the UV-light source 12 comprises a UV LED and focusing means (not shown) arranged to focus the UV light, so that a focused UV beam is generated illuminating a small spot of the photochromic material 15, and comprises a beam controller 20 to move the focused UV beam across the photochromic layer 16, leaving a track of photochromic material 15 of increased color intensity. The beam controller 20 may comprise a mirror whose orientation can be controlled. In another embodiment, the UV-light source is mounted on an arrangement that is capable of changing the orientation of the UV-light source in order to move the spot of UV-light across the photochromic material 15.

The visible-light sources 10 may be, for example, LEDs, although also one or more visible-light sources 10 may be selected from the group comprising filament lamps, fluorescent lamps (especially tubular luminescent (TL) lamps, and compact fluorescent lamps (CFL)), halogen lamps, low-pressure gas discharge lamps, high pressure gas discharge lamps, LEDs, and optionally also OLEDs. Any visible light source which substantially does not emit UV-light can be used in principle.

It should further be noted that for some UV-photochromic materials the fade rate or recovery time is dependent on the temperature of the UV-photochromic material 15. The fade rate increases, i.e. the fade time shortens, with an increase in temperature. For such materials, a laser beam of IR light from an IR-light source 21 may be used to increase the temperature of the photochromic material locally. This results in a quicker decrease of the color intensity of the heated material, which becomes apparent as patterns in the photochromic material that result in an additional light effect in the visible light projected from the lighting device 1.

Figure 5:
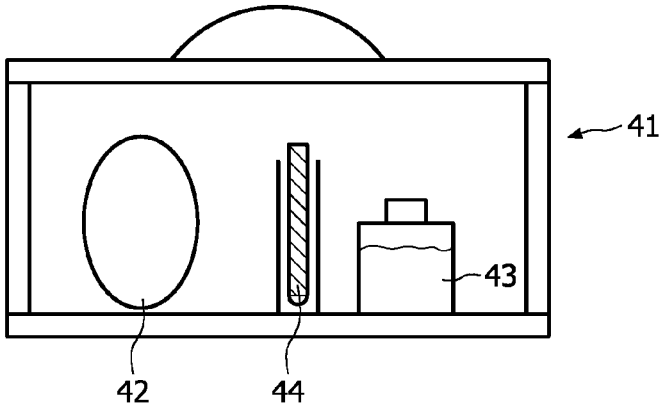
FIG. 5 schematically depicts a kit of parts for generating a detachable unit for use in a lighting device according to the invention.

FIG. 5 schematically depicts a kit of parts for generating a detachable unit 30 for use in a lighting device according to the invention. As stated above, the photochromic layer 16 may be part of a detachable unit 30. The detachable unit 30 comprises a support on which the photochromic material 15 is applied. The detachable unit 30 may include the light exit window 14 of the lighting device 1, as shown in FIG. 3. The detachable unit 30 may alternatively be a slide insert which is to be inserted upstream of the light exit window 14. By interchanging detachable units 30 a user can select different designs of photochromic ink. A user can generate a detachable unit 30 with his own design by means of a kit 41 of parts comprising a transparent body 42 and one or more containers 43 with UV-photochromic ink. Optionally, the kit 41 of parts further comprises a tool 44 for writing on the photochromic material with a UV LED pen. Fading patterns may be created in this manner. The UV LED pen may be used to draw a pattern on the photochromic material of the detachable unit to obtain hand drafted patterns of photochromic material of increased intensity.

Note that the terms first and second, and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than those described or illustrated herein.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a", "an" or "the" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting device, comprising:

a housing;

one or more visible-light sources for generating visible light arranged in the housing;

one or more UV-light sources for generating UV-light arranged in the housing;

a light exit window defined in the housing and positioned to allow transmission of the visible light;

a photochromic layer positioned upstream of the light exit window and downstream of the one or more visible-light sources, said photochromic layer comprising at least one area comprising UV-photochromic material having a first color state and a second color state, wherein the photochromic layer comprises at least two areas comprising different UV-photochromic materials having different recovery times;

a control unit connected to the one or more UV-light sources for controlling the one or more UV-light sources, wherein the UV-light sources are arranged to illuminate the photochromic layer; and a first UV-filter arranged downstream of the light exit window.

2. The lighting device according to claim 1 comprising two or more UV-light sources, each of the two or more UV-light sources being arranged to expose different areas of the photochromic layer during operation.

3. The lighting device according to claim 2, wherein the control unit is arranged to control the two or more UV-light sources independently of each other.

4. The lighting device according to claim 1, wherein the photochromic material is applied to an inner side of the light exit window.

5. The lighting device according to claim 1, further comprising a second UV-filter provided downstream of the one or more UV-light sources and upstream of the photochromic material, wherein the UV-filter has a predetermined recovery time.

6. The lighting device according to claim 5, further comprising an IR-light source for generating IR-light, wherein the second UV-filter comprises a thermoscattering material.

7. The lighting device according to claim 1, wherein the control unit is configured to generate PWM signals to control the UV-light sources for effectuate the transition from the first color state to the second color state.

8. The lighting device according to claim 1, wherein the control unit is configured to control the intensity of the color of the UV-photochromic material.

9. The lighting device according to claim 1, wherein the UV-light source is configured to generate a spot of UV-light on the photochromic material, and wherein the lighting device further comprises a beam controller for guiding the spot of UV-light across the photochromic material.

10. A lighting device, comprising:

a housing;

one or more visible-light sources for generating visible light arranged in the housing;

one or more UV-light sources for generating UV-light arranged in the housing;

a light exit window defined in the housing and positioned to allow transmission of the visible light;

a photochromic layer positioned upstream of the light exit window and downstream of the one or more visible-light sources, said photochromic layer comprising at least one area comprising UV-photochromic material having a first color state and a second color state;

a control unit connected to the one or more UV-light sources for controlling the one or more UV-light sources, wherein the UV-light sources are arranged to illuminate the photochromic layer;

a first UV-filter arranged downstream of the light exit window; and a second UV-filter provided downstream of the one or more UV-light sources and upstream of the photochromic material, wherein the UV-filter has a predetermined recovery time.

11. The lighting device according to claim 10, further comprising an IR-light source for generating IR-light, wherein the second UV-filter comprises a thermoscattering material.

12. The lighting device according to claim 10, wherein at least one of the one or more UV-light sources is configured to generate a spot of UV-light on the photochromic material, and wherein the lighting device further comprises a beam controller for guiding the spot of UV-light across the photochromic material.

13. The lighting device according to claim 10, wherein the control unit is configured to generate PWM signals to control the UV-light sources for effectuate the transition from the first color state to the second color state.

14. A lighting device, comprising:

a housing;

one or more visible-light sources for generating visible light arranged in the housing;

one or more UV-light sources for generating UV-light arranged in the housing;

a light exit window defined in the housing and positioned to allow transmission of the visible light;

a photochromic layer positioned upstream of the light exit window and downstream of the one or more visible-light sources, said photochromic layer comprising at least one area comprising UV-photochromic material having a first color state and a second color state;

a control unit connected to the one or more UV-light sources for controlling the one or more UV-light sources, wherein the control unit is configured to generate PWM signals to control the UV-light sources for effectuate the transition from the first color state to the second color state, and wherein the UV-light sources are arranged to illuminate the photochromic layer; and a first UV-filter arranged downstream of the light exit window.

* * * * *